US005411145A

United States Patent [19]

Parks

[11] Patent Number: 5,411,145

[45] Date of Patent: May 2, 1995

[54] PORTABLE FILE ORGANIZING RACK

[76] Inventor: Barber J. Parks, 2288 Old Quarry Rd., Golden, Colo. 80401

[21] Appl. No.: 138,712

[22] Filed: Oct. 18, 1993

[51] Int. Cl.[6] ..... A47F 5/00

[52] U.S. Cl. ..... 211/50; D6/475

[58] Field of Search ..... 211/50, 49.1; D6/475

[56] References Cited

U.S. PATENT DOCUMENTS

| | | | |
|---|---|---|---|
| D. 168,423 | 12/1952 | Schiffer . | |
| D. 181,050 | 9/1957 | Harden | D6/475 X |
| 418,310 | 12/1889 | Cott . | |
| 1,096,731 | 12/1914 | Lounsbury . | |
| 1,119,810 | 12/1914 | Davis . | |
| 1,372,516 | 3/1921 | Kimball . | |
| 1,686,862 | 10/1928 | King . | |
| 1,838,681 | 12/1931 | Hutchings | 211/50 |
| 2,691,447 | 10/1954 | Schiffer | 211/50 |
| 3,164,254 | 1/1965 | Gorc | 211/42 |
| 3,447,677 | 6/1969 | Aitkens | 211/50 X |
| 5,106,047 | 4/1992 | Baer | 248/174 |
| 5,272,966 | 12/1993 | Dixon | 211/50 X |

FOREIGN PATENT DOCUMENTS

| | | | |
|---|---|---|---|
| 1066042 | 6/1954 | France | 211/50 |

*Primary Examiner*—Robert W. Gibson, Jr.
*Attorney, Agent, or Firm*—John E. Reilly

[57] ABSTRACT

A file rack has been devised for placement on a table or other level surface to support flat materials, such as, file folders in a generally upright position but in staggered relation so as to be readily identifiable, the file rack consisting of an elongated bed having an end wall across one end and spaced base support panels either at longitudinally spaced intervals along and beneath the bed or extending downwardly from opposite sidewalls in a lengthwise direction.

15 Claims, 2 Drawing Sheets

PORTABLE FILE ORGANIZING RACK

SPECIFICATION

This invention relates to file supporting and organizing devices; and more particularly relates to a novel and improved file organizer rack adapted to be placed on a table or other level surface to support one or more file folders and their contents in a generally upright position.

BACKGROUND AND FIELD OF INVENTION

Professional and business offices require an effective means for temporary storage and organization of file folders so as to be readily accessible throughout the working day. In this way, it is not necessary to place the files in or remove them from larger file cabinets except for more permanent storage.

There is an increasing demand for an open portable rack to permit stacking of file folders so that the folders can be easily placed on and retrieved from the rack, and the folders can be supported together in somewhat staggered relation to one another so that each file is readily identifiable by the tab on its upper edge and can be easily retrieved. For example, portable file supports which are now in widespread use in professional and business offices include baskets in which the file folders are laid flat and the entire stack of file folders must be removed from the basket in order to identify the individual folders. Vertical dividers are also in use in which a common base support has a number of closely spaced vertical dividers so that file folders can be vertically positioned and supported in the spaces between the dividers.

Other types of racks have been devised for supporting different articles. For example, the early expired U.S. Pat. No. 1,686,862 to J. W. King discloses a napkin holder having a generally V-shaped pocket closed off by end walls at each end. U.S. Pat. No. 1,096,731 to W. S. Lounsbury discloses a rack for holding loose leaves but also closed at both ends. U.S. Pat. No. 418,310 to C. M. Cott discloses a trough for straightening and handling sheets of paper while being glued together to form tablets and wherein the trough is closed at one end by a notched portion; and further a pressboard is removably positioned in the trough along with a second board used to clamp the tablets together. U.S. Pat. Nos. 168,423 and 2,691,447 to S. S. Schiffer each disclose a rack which is supported in an inclined position on a base support and has an end support at one end. Other representative are U.S. Pat. Nos. 1,119,810 to F. E. Davis, 1,372,516 to J. A. Kimball, 3,164,254 to J. F. Gorc and 5,106,047 to S. M. Baer.

SUMMARY OF INVENTION

It is therefore an object of the present invention to provide for a novel and improved supporting unit for file folders and wherein the unit is of the open portable type to be placed on a level surface, such as, a table, desktop or the like.

It is another object of the present invention to provide for a novel and improved file supporting rack for file folders which can stack a maximum number of files in staggered relation within a limited space and enable ease of removal of one or more files without disturbing the other files.

It is a further object of the present invention to provide for a novel and improved rack for organizing and supporting file folders which is lightweight, of simple construction and will occupy a minimum of space.

It is an additional object of the present invention to provide for a novel and improved file rack of open-ended construction which facilitates insertion and removal of file folders in a convenient location so as to be readily accessible for insertion and removal of the file folders.

In accordance with the present invention, a file rack has been devised for supporting items, such as, generally rectangular file folders in a substantially upright position comprising an elongated bed having upwardly divergent sidewalls which define a common trough therebetween, the bed being of a length sufficient to support each file folder lengthwise along the bed with a lower edge of the folder disposed in the trough, an end wall member extending transversely across and closing one end of the bed to serve as a stop for an end of each folder disposed on the bed, and base support means extending downwardly from the sidewalls to support the bed on a level surface so that the sidewalls will diverge upwardly from the trough. In particular, it is desirable that the sidewalls diverge upwardly at substantially uniform angles which are symmetrical about an imaginary vertical plane extending through the trough so that a series of file folders can be stacked in staggered relation with their lower edges resting against one sidewall so as to make the tabs readily identifiable on the folders.

The base support means may be in the form of panels which are disposed either at longitudinally spaced locations beneath the bed or extend downwardly from the sidewalls. In the preferred form, the base support panels diverge somewhat downwardly and away from the upper terminal edges of the sidewalls to define a rack of generally M-shaped cross-sectional configuration so as to achieve a sturdy construction and stable support for the files as well as to make the racks nestable and easily transportable in series and in a compact condition. In a modified form, the base support panels may be arranged at longitudinally spaced intervals beneath the bed and with one base support panel also serving as an end wall at one end of the bed.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
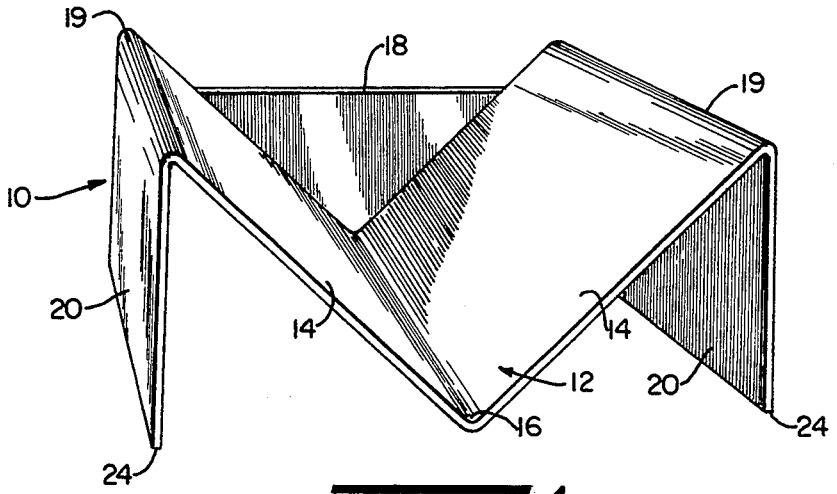
FIG. 1 is a perspective view of a preferred form of file rack in accordance with the present invention.
Figure 2:
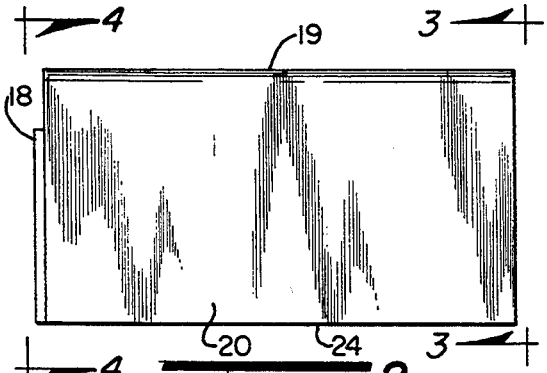
FIG. 2 is a side view in elevation of the preferred form illustrated in FIG. 1.
Figure 3:
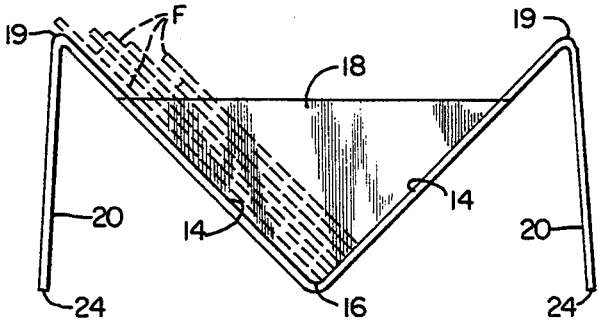
FIG. 3 is a front view in elevation of the preferred form of invention of FIG. 1.
Figure 4:
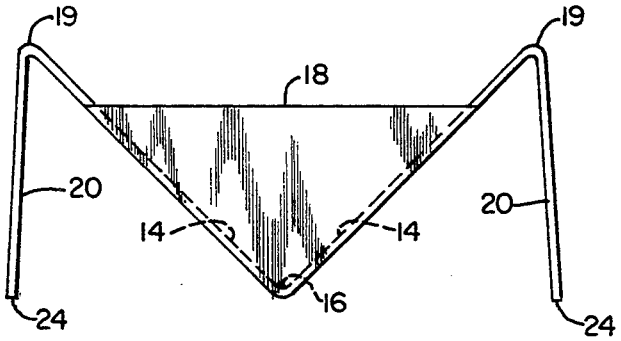
FIG. 4 is a rear end view of the preferred form of invention of FIG. 1.

Referring in detail to the drawings, a preferred embodiment of invention is shown in FIGS. 1 to 4 which takes the form of an open portable file rack 10. The rack 10 is of the portable type which can be manually lifted and easily transported from place to place and is specifically adapted to be placed on a flat or level surface, such as, a table or desktop, not shown. The rack 10 is constructed entirely of sturdy, rigid materials, such as, wood or plastic and is made up of an elongated bed 12 having a pair of flat sidewall panels 14 diverging upwardly and away from a common line of intersection which defines a trough 16. A generally triangular end wall 18 extends transversely across one end of the bed 12 so as to close off that end and to serve as an end stop for file folders F which are to be placed on the bed 12. The opposite end of the bed 12 is left open so that files can be readily inserted endwise in a horizontal direction or deposited more in an edgewise fashion from above.

In order to support the bed 12 on a level surface, vertical base support panels 20 extend downwardly from upper edges 19 of the sidewalls, the panels 20 terminating in lower edges 24 which are aligned in a common plane with the trough 16, or if desired, the trough 16 may be raised slightly with respect to the lower terminal edges 24 so that the entire rack rests on the lower edges 24 when placed on a level surface. The panels 20 are of corresponding size from top to bottom thereby supporting the sidewalls 14 at substantially uniform angles to the surface on which the rack is supported and to a common vertical plane passing through the trough 16. Preferably, the sidewalls 14 are aligned at 90° to one another and at 45° to the vertical plane through the trough so that the file folders can conveniently lay against one of the sidewalls, illustrated in FIG. 3, so that the tabs on the upper edges of the file folders are exposed for ease of identification. Any number of folders F can be stacked as represented; and, when inserted, each folder can be tossed or placed on the bed until one end of the file abuts the end wall 18. When a number of files are stacked as illustrated, it is a simple matter to riffle through the file folders, or to locate a file by individually pivoting or turning each file folder over to the opposite sidewall until the desired file appears.

Preferably, the rack 10 is constructed with the bed 12 and base support panels 20 of one-piece construction and of generally M-shaped cross-sectional configuration. The end wall 18 is affixed by bonding its inclined edges to the edges of the sidewalls 14. The assembly of the end wall may be done at the manufacturing site or can be done after shipment; and in either case the beds and base support panels 20 can be nested together in shipment.

DETAILED DESCRIPTION OF MODIFIED FORM OF INVENTION

Figure 5:
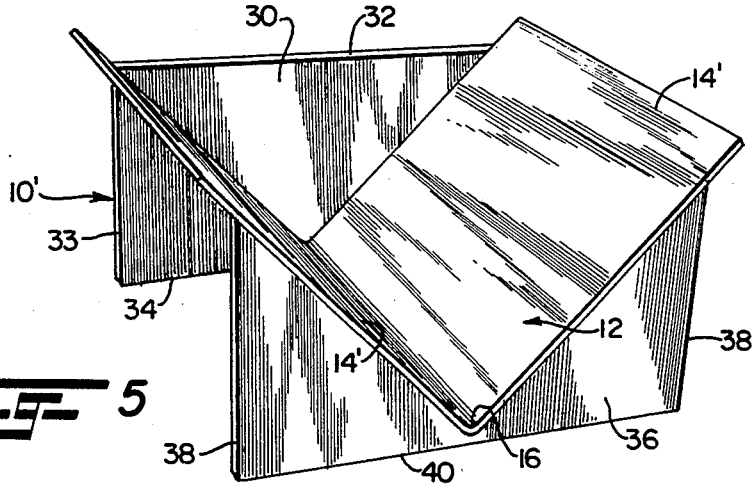
FIG. 5 is a perspective view of a modified form of invention.
Figure 6:
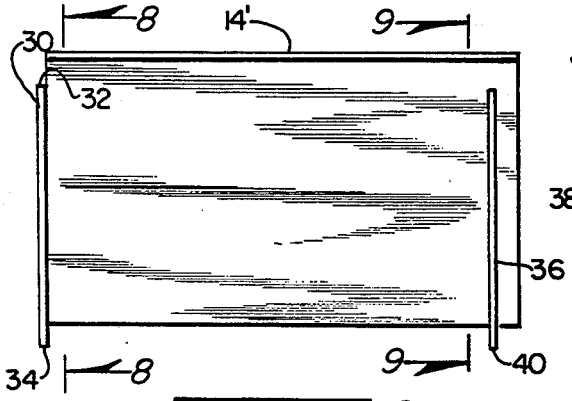
FIG. 6 is a side view in elevation of the modified form illustrated in FIG. 5.
Figure 7:
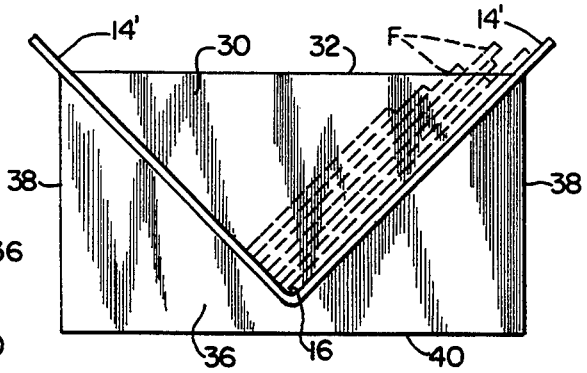
FIG. 7 is an end view in elevation of the modified form of invention.
Figure 8:
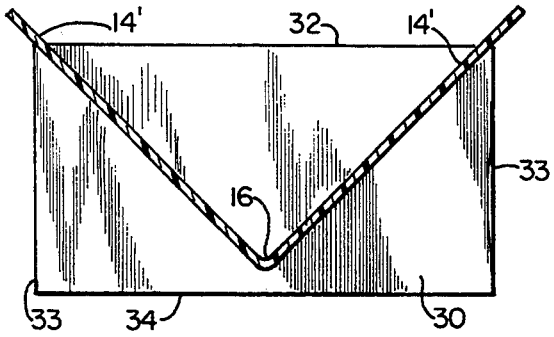
FIG. 8 is a cross-sectional view taken about lines 8—8 of FIG. 6.
Figure 9:
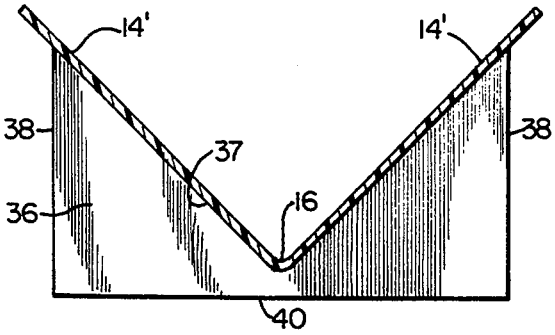
FIG. 9 is a cross-sectional view taken about lines 9—9 Of FIG. 6.

In the modified form of FIGS. 5 to 8, like elements to those of the preferred form are correspondingly enumerated with prime numbers. In this form, a rack 10′ is again comprised of a bed 12′ which is formed in a corresponding manner to that of the preferred form of bed 12 with a pair of sidewalls 14′ diverging upwardly from a common trough 16′. An end wall 30 is disposed at one end of the sidewalls, the end wall 30 being of generally rectangular configuration so that the upper portion of the end wall serves as a closure at one end of the sidewalls 14′, and the lower end portion of the end wall 30 serves as a base support member at one end of the rack 10′. Specifically, the end wall comprises an upper horizontal edge 32 which terminates just beneath the upper terminal edges of the sidewalls 14′ when the end wall is affixed to the end of the sidewalls 14′. Opposite side edges 33 extend vertically in spaced parallel relation to one another beneath the sidewalls and terminate in a lower horizontal edge 34. A second base support member is defined by a panel 36 having an upper V-shaped notch 37, opposite side edges 38 and a lower horizontal edge 40. The end wall 30 is affixed to the one end of the bed 12, by a suitable bonding agent, and the panel 36 is similarly affixed to the undersurface of the bed in longitudinally spaced, parallel relation to the end wall 30 so as to be relatively close to the opposite end of the bed and away from the one end of the bed which is affixed to the end wall 30. In this way, the end wall 30 and panel 36 define a stable support for the bed to enable it to be placed on a level surface with the sidewalls 14′ diverging upwardly at substantially uniform angles to a common vertical plane through the trough 16′.

In this form of invention as described, the end wall 30 is bonded to the edges of the sidewalls 14′ at one end, and the panel 36 is bonded to the undersurface of the bed 12′ so that the bed is spaced above the level surface in a horizontal attitude or can be tipped slightly toward the end wall 30.

In both forms of invention, the base support members offer a broad base support for the rack 10 or 10′ so that a number of file folders can be stacked and supported by the rack without tending to tip the rack. Moreover, the construction of both forms of racks lends itself well to placement of any number of racks in side-by-side relation across a support surface or can be positioned end-to-end with their end walls in confronting relation to one another.

It is therefore to be understood that while preferred and modified forms of invention have been herein set forth and described, various modifications and changes may be made therein without departing from the spirit and scope of the invention as defined by the appended claims.

I claim:

1. A file rack in combination with a plurality of generally rectangular file folders, each of said folders having a front side and a back side joined together along a common bottom edge, comprising:

an elongated bed having a pair of upwardly divergent sidewalls each having a generally flat surface and a common trough therebetween, said bed being of a length sufficient to support each folder lengthwise along said bed with a lower edge of each said file folder disposed lengthwise in said trough in contact with one of said sidewalls, the other of said pair of sidewalls supporting at least one side of one of said folders;

an end wall member extending transversely across and closing only one end of said bed to define a stop for an end of each said file folder disposed along said bed; and spaced base support means extending downwardly from said sidewalls for supporting said bed on a level surface such that said sidewalls diverge upwardly from said trough and said folders will lay against one of said sidewalls.

2. A file rack according to claim 1, said sidewalls diverging upwardly at substantially uniform angles symmetrically about an imaginary vertical plane extending through said trough.

3. A file rack according to claim 1, said base support means disposed at longitudinally spaced locations beneath said bed.

4. A file rack according to claim 1, said base support means including vertical panels extending downwardly from said sidewalls and in a lengthwise direction in substantially parallel relation to one another.

5. A file rack according to claim 4, said sidewalls each terminating in an upper free edge, each of said panels extending downwardly from said upper terminal edge of one of said sidewalls.

6. A file rack according to claim 1, said sidewalls each being of a width corresponding to the width of said file folders disposed on said bed.

7. A file rack according to claim 1, said sidewalls diverging upwardly at an angle such that one or more of said file folders are supported against one sidewall.

8. A portable file rack for stacking file folders and the like in a substantially upright position comprising:

an elongated bed having upwardly divergent sidewalls and a common trough therebetween, said bed dimensioned to support each said folder in a direction lengthwise of said bed and leaning against one of said sidewalls;

an end wall of generally triangular configuration extending transversely across and closing one end of said bed whereby to define an end stop for said file folders disposed in said bed; and side support panels extending downwardly from said sidewalls, each of said side support panels extending the substantial length of said bed and diverging away from each other.

9. A portable file rack according to claim 8, said bed and said side support panels together being of generally M-shaped cross-sectional configuration.

10. A portable file rack according to claim 8, each of said sidewalls and said side support panels being of generally rectangular configuration, said side support panels extending downwardly from upper terminal edges of said sidewalls.

11. A file rack in combination with a plurality of generally rectangular file folders, the combination comprising:

each of said folders having a front side and a back side joined together along a common bottom edge;

an elongated bed having a pair of upwardly divergent sidewalls and a common horizontal trough therebetween, each of said sidewalls having an upper edge generally parallel to said common trough, said bed being of a length sufficient to support each folder lengthwise along said bed with a lower edge of each said file folder disposed lengthwise in said trough in contact with one of said sidewalls, the other of said pair of sidewalls supporting at least one side of one of said folders;

an endwall member extending transversely across and closing one end of said bed to define a stop for an end of each said file folder disposed along said bed; and a pair of spaced base support means each diverging downwardly from said upper edges of said sidewalls for supporting said bed on a level surface.

12. The combination according to claim 11 wherein each of said base support means is a rectangular panel extending a sufficient distance downward from said upper edge of said side wall to said level surface so that said panels support said trough above said level surface.

13. The combination according to claim 11 wherein each of said base support means is a rectangular panel extending downward from said upper edge of said side wall to said level surface so that said panels and said trough rest on said level surface.

14. The combination according to claim 12 wherein said end wall is a triangular panel attached to said sidewalls at one end of said bed to maintain said sidewalls at a predetermined angle therebetween.

15. In a file rack adapted to be used in combination with a plurality of generally rectangular file folders, each of said folders having a front side and a back side joined together along a common bottom edge, said rack having a pair of upwardly divergent sidewall panels forming a common trough therebetween, said trough being of a length sufficient to fully support each folder lengthwise along said trough with a lower edge of each said file folder disposed lengthwise in said trough in contact with one of said sidewalls, the other of said pair of sidewalls supporting at least one side of one of said folders, wherein the improvement comprises an end wall member extending transversely across and closing only one end of said trough to define a stop for an end of each said file folder disposed along said bed and spaced base support panels extending downwardly and divergingly from upper edges of said sidewalls for supporting said bed horizontally on a level surface.

* * * * *